US010150021B2

(12) United States Patent
Kitagawa

(10) Patent No.: US 10,150,021 B2
(45) Date of Patent: Dec. 11, 2018

(54) GOLF CLUB HEAD

(71) Applicant: Bridgestone Sports Co., Ltd., Tokyo (JP)

(72) Inventor: Tomonori Kitagawa, Tokyo (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/481,678

(22) Filed: Apr. 7, 2017

(65) Prior Publication Data

US 2017/0361178 A1 Dec. 21, 2017

(30) Foreign Application Priority Data

Jun. 15, 2016 (JP) ..... 2016-119122

(51) Int. Cl.
*A63B 53/04* (2015.01)

(52) U.S. Cl.
CPC .... *A63B 53/0475* (2013.01); *A63B 2053/042* (2013.01)

(58) Field of Classification Search
USPC ..... 473/324–350
See application file for complete search history.

(56) References Cited

U.S. PATENT DOCUMENTS 2,429,351 A * 10/1947 Fetterolf ..... A63B 53/04 473/329
5,431,396 A * 7/1995 Shieh ..... A63B 53/04 473/329
5,536,006 A * 7/1996 Shieh ..... A63B 53/04 473/342
5,993,329 A * 11/1999 Shieh ..... A63B 53/04 473/329
6,319,149 B1 * 11/2001 Lee ..... A63B 53/04 228/125
6,364,789 B1 * 4/2002 Kosmatka ..... A63B 53/04 473/329
6,491,593 B2 * 12/2002 Takeda ..... A63B 53/04 473/342
6,878,073 B2 * 4/2005 Takeda ..... A63B 53/04 473/345
6,918,841 B2 * 7/2005 Chen ..... A63B 53/04 473/342

(Continued)

FOREIGN PATENT DOCUMENTS

JP 03-007178 A 1/1991
JP 2002191730 A * 7/2002 ..... A63B 53/04

(Continued)

*Primary Examiner* — Alvin Hunter
(74) *Attorney, Agent, or Firm* — Sughrue Mion, PLLC

(57) ABSTRACT

A hollow golf club head includes a face portion. The head includes a hollow head body, a face member that forms the face portion, and a connecting portion provided between the head body and the face member connects the head body and the face member. The head body includes a front surface to which the face member is connected through the connecting portion. The front surface of the head body includes an opening portion and a first concave portion formed around the opening portion and on which the connecting portion is arranged. The back surface of the face member includes a second concave portion on which the connecting portion is arranged.

9 Claims, 8 Drawing Sheets

(56) References Cited

U.S. PATENT DOCUMENTS 6,964,617 B2 * 11/2005 Williams ..... A63B 53/0466 473/245
7,226,366 B2 * 6/2007 Galloway ..... A63B 53/0466 473/332
7,258,628 B2 * 8/2007 Huang ..... A63B 53/0466 473/342
7,413,517 B2 * 8/2008 Butler, Jr. ..... A63B 53/0466 473/288
7,604,549 B2 * 10/2009 Sugimoto ..... A63B 53/047 473/342
7,641,569 B2 * 1/2010 Best ..... A63B 53/0487 473/329
7,682,264 B2 * 3/2010 Hsu ..... A63B 53/0466 473/342
7,967,700 B2 * 6/2011 Stites ..... A63B 53/0466 473/342
8,206,241 B2 * 6/2012 Boyd ..... A63B 53/0466 473/332
8,517,858 B2 * 8/2013 Soracco ..... A63B 53/0466 473/329
8,753,228 B2 6/2014 Golden et al.
8,956,248 B2 * 2/2015 DeMille ..... A63B 53/0466 473/342
8,961,332 B2 2/2015 Galvan et al.
9,089,747 B2 * 7/2015 Boyd ..... A63B 53/0466
9,561,408 B2 * 2/2017 Bezilla ..... A63B 53/0466
2015/0352412 A1 12/2015 Narita et al.

FOREIGN PATENT DOCUMENTS

JP 2004-216131 A 8/2004
JP 2005000576 A * 1/2005
JP 2005103161 A * 4/2005
JP 2008-525117 A 7/2008
JP 2014008287 A * 1/2014
JP 2015-231485 A 12/2015
WO 2006/069251 A2 6/2006

* cited by examiner

GOLF CLUB HEAD

BACKGROUND OF THE INVENTION

Field of the Invention

The present invention relates to a golf club head.

Description of the Related Art

As a structure for improving the ball striking performance of a golf club head, a structure having an elastic member interposed between a head body and a face member and a structure in which a face member can be displaced with respect to a head body have been proposed (for example, Japanese Patent Laid-Open No. 2015-231485, Japanese Patent Laid-Open No. 2008-525117, Japanese Patent Laid-Open No. 2004-216131, Japanese Patent Laid-Open No. 03-007178, U.S. Pat. Nos. 9,089,747, 8,961,332, and 8,753,228).

When a golf club head strikes a golf ball, there is an impact on a face member. In a structure having an elastic member connecting portion interposed between a face member and a head body, there is room for improvement in durability since the durability against impact may be inferior to that of a structure in which the head body and the face member have been directly joined.

SUMMARY OF THE INVENTION

It is an object of the present invention to improve the ball striking performance and increase the durability of the connection between a head body and a face member.

According to the present invention, there is provided, for example, a hollow golf club head that includes a face portion, comprising: a hollow head body; a face member that forms the face portion; and a connecting portion that is provided between the head body and the face member and connects the head body and the face member, wherein the head body includes a front surface to which the face member is connected through the connecting portion, the front surface of the head body includes: an opening portion; and a first concave portion formed around the opening portion and on which the connecting portion is arranged, and the back surface of the face member includes a second concave portion on which the connecting portion is arranged.

Further features of the present invention will become apparent from the following description of exemplary embodiments (with reference to the attached drawings).

DESCRIPTION OF THE EMBODIMENTS

<First Embodiment>

Figure 1A:
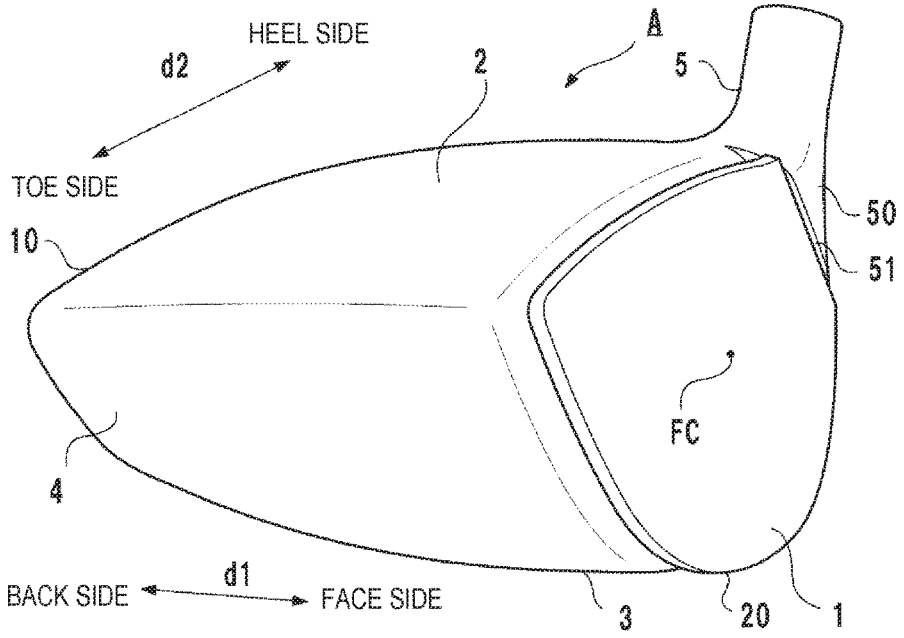
FIG. 1A is a perspective view of a golf club head according to an embodiment of the present invention.
Figure 1B:
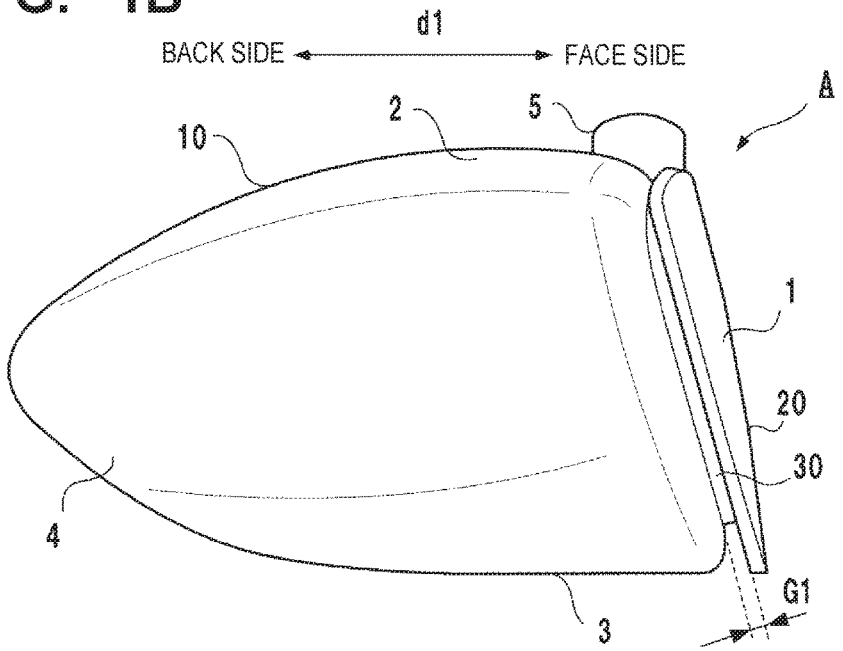
FIG. 1B is a side view of the golf club head of FIG. 1A.
Figure 2A:
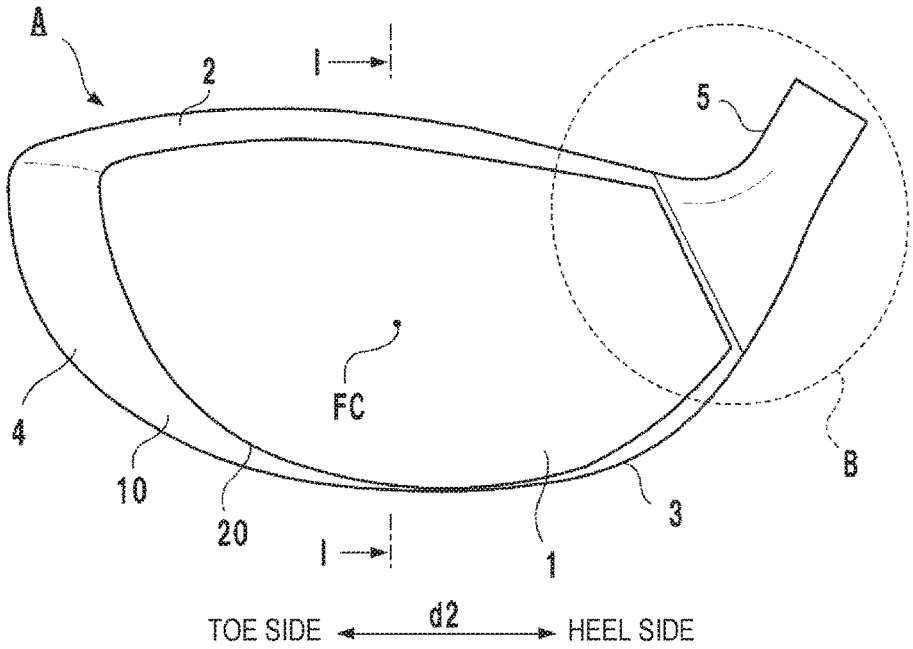
FIG. 2A is a front view of the golf club head of FIG. 1A.
Figure 3A:
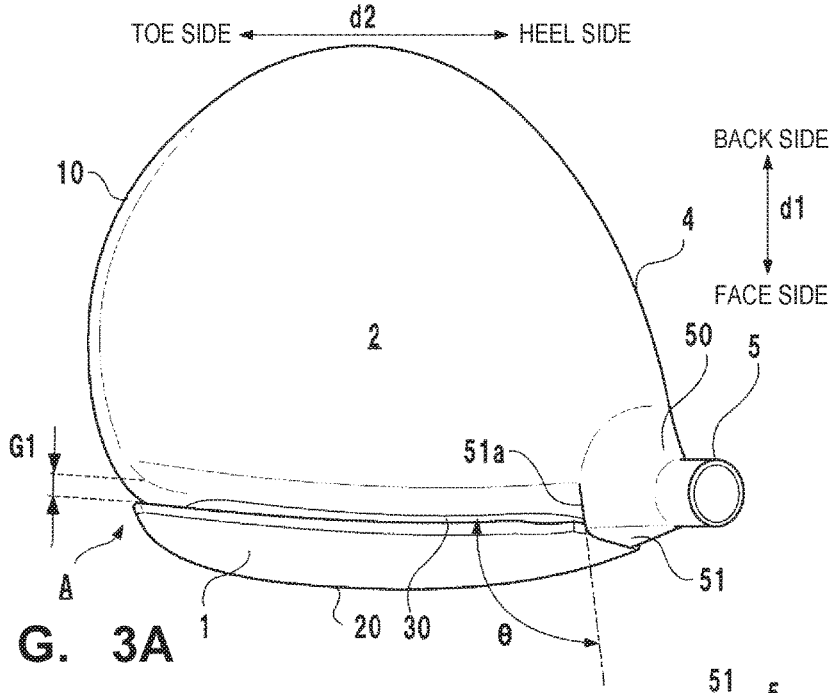
FIG. 3A is a plan view of the golf club head of FIG. 1A.
Figure 3B:
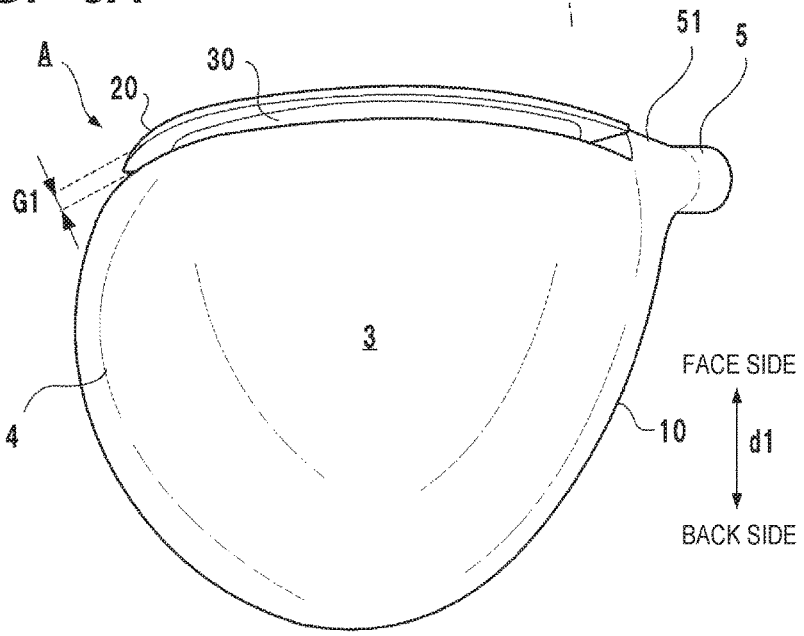
FIG. 3B is a bottom view of the golf club head of FIG. 1A.

FIG. 1A is a perspective view of a golf club head A according to the first embodiment of the present invention, FIG. 1B is a side view of the golf club head A (a view from a toe side), FIG. 2A is a front view of the golf club head A (a view from the side of a face portion), FIG. 3A is a plan view of the golf club head A, and FIG. 3B is a bottom view of the golf club head A.

The golf club head A forms a hollow member. Its peripheral walls form a face portion 1, a crown portion 2, a sole portion 3, and a side portion 4. The surface of the face portion 1 forms a face (a striking surface). The crown portion 2 forms the upper portion of the golf club head A. The sole portion 3 forms the bottom portion of the golf club head A. The side portion 4 forms the portion between the sole portion 3 and the crown portion 2. The golf club head A also includes a hosel portion 5 to which a shaft is attached.

An arrow d1 in FIG. 1A indicates a face-back direction, and an arrow d2 indicates a toe-heel direction. The face-back direction is normally a target line direction (the target direction of a shot). The toe-heel direction can be defined as, for example, a direction in which the toe-side end and the heel-side end of the sole portion 3 are connected or a direction perpendicular to the face-back direction. The vertical direction of the face portion 1 is defined based on the golf club head A grounded in accordance with a predetermined lie angle. In this embodiment, the vertical direction is the direction of the sole portion 3 and the crown portion 2. Note that the lie angle is an angle made by a shaft axis line and the ground surface.

The golf club head A is a golf club head for a driver. However, the present invention is applicable to various kinds of hollow golf club heads such as those of fairway woods and utility golf clubs (hybrid golf clubs) other than those of drivers.

Figure 4:
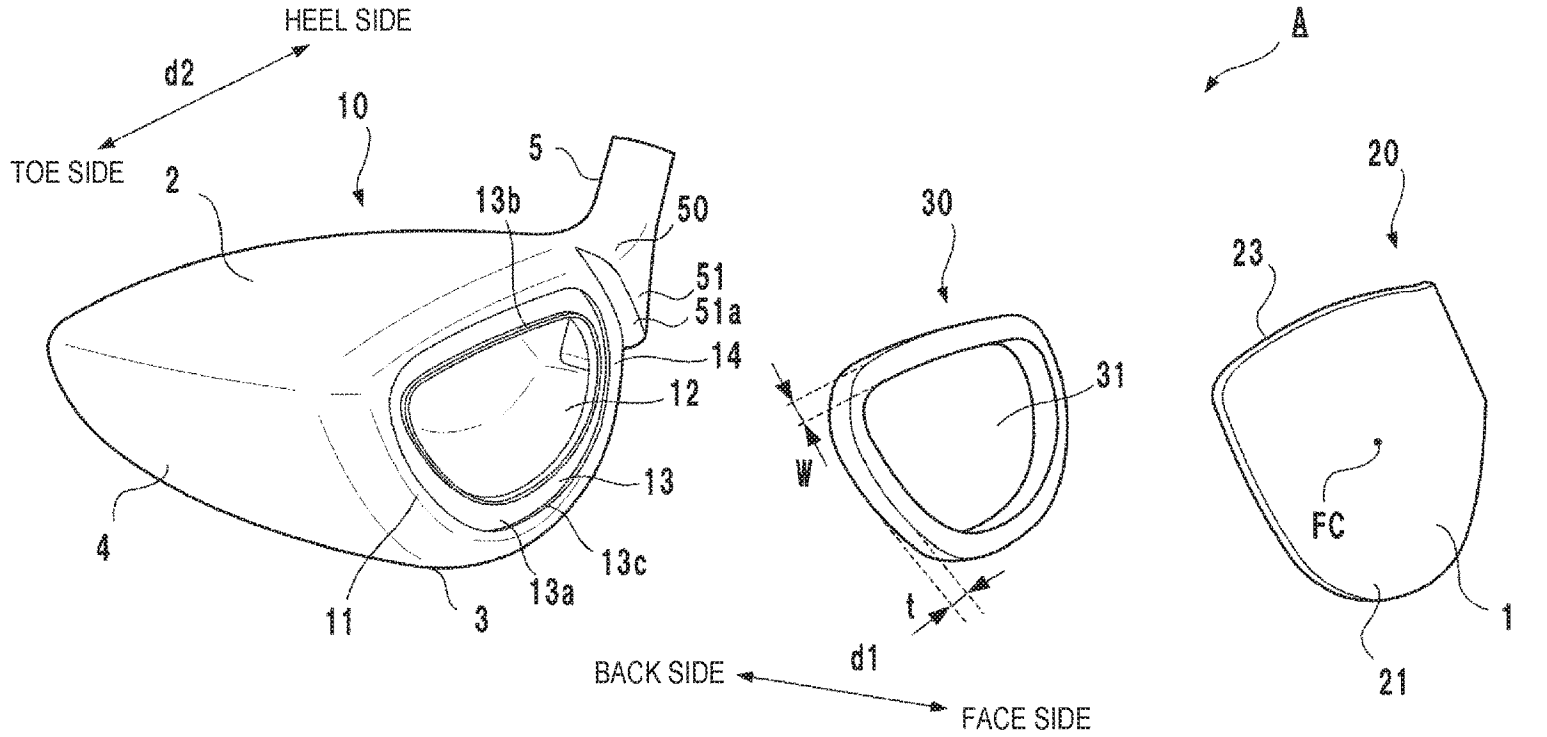
FIG. 4 is an exploded perspective view of the golf club head of FIG. 1A.

In this embodiment, the golf club head A is assembled by joining a plurality of parts. FIG. 4 is an exploded perspective view of the golf club head A. The golf club head A includes a head body 10, a face member 20, and a connecting portion 30. Furthermore, the head body 10 can be assembled by joining a plurality of parts.

Figure 5A:
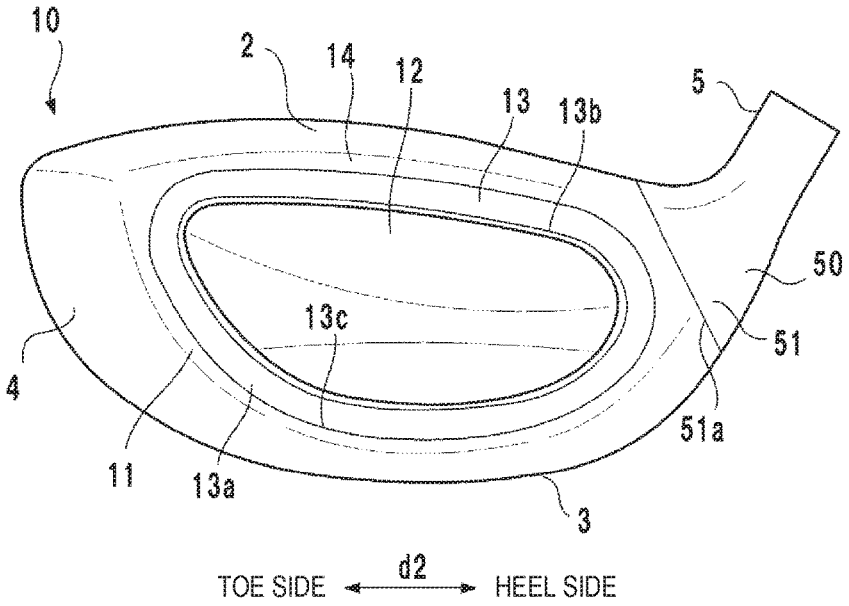
FIG. 5A is a front view of a head body.
Figure 5B:
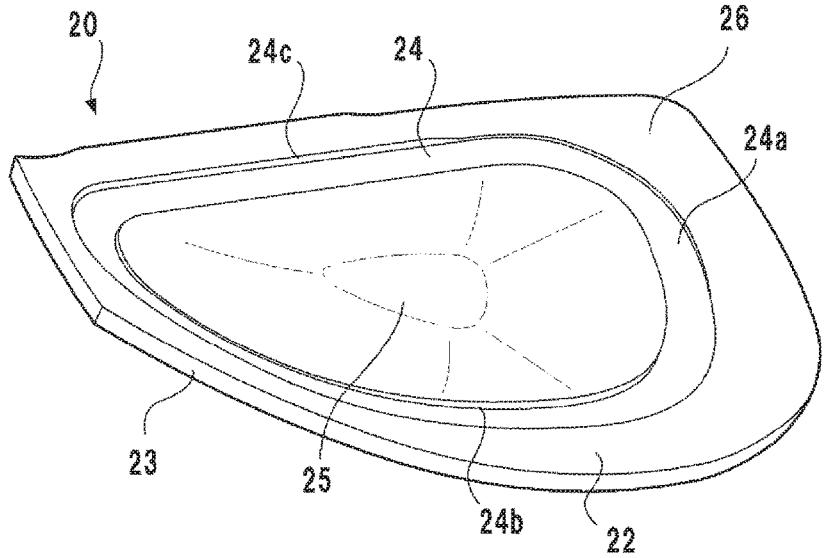
FIG. 5B is a perspective view of a face member.

FIG. 5A is a front view of the head body 10, and FIG. 5B is a perspective view (a perspective view from the back side) of the face member 20.

The head body 10 is a hollow member forming the crown portion 2, the sole portion 3, the side portion 4, the hosel portion 5, and a base 50 of the hosel portion 5. The face member 20 is a plate-like member forming the face portion 1. The connecting portion 30 is provided between the head body 10 and the face member 20 and connects the head body 10 and the face member 20.

The material for the head body 10 and the face member 20 is, for example, a metal material such as a titanium-based metal (for example, a 6Al-4V-Ti titanium alloy), stainless steel, or an aluminum alloy. The material of the connecting portion 30 is a metal material with rigidity lower than the head body 10 and the face member 20 or a nonmetallic material. The nonmetallic material can be, for example, a rubber material, a resin material, or a carbon fiber material. The rubber material can be, for example, natural rubber, polybutadiene rubber, styrene-butadiene rubber, or isoprene rubber. The resin material can be, for example, an ionomer resin, a urethane resin, a polyester resin, or a polyamide resin. If a rubber material or a resin material is adopted as the material of the connecting portion 30, the material has, for example, a Shore D hardness of 20 (inclusive) to 80 (inclusive).

The head body 10 has a front surface 11 to which the face member 20 is connected through the connecting portion 30. The front surface 11 includes an opening portion 12, a first concave portion 13, and a peripheral portion 14. The opening portion 12 is located in the middle of the front surface 11 and communicates with the internal space of the head body 10. The concave portion 13 is a portion recessed more than the peripheral portion 14 and is an annular groove formed around the opening portion 12. The connecting portion 30 is arranged in the concave portion 13. The concave portion 13 has an annular shape and surrounds the opening portion 12. The concave portion 13 includes a bottom wall 13*a* and inner walls 13*b* and 13*c* which face each other. The inner wall 13*b* is a side wall of the concave portion 13 on the side of the opening portion 12. In other words, it is an inner peripheral wall. The inner wall 13*c* is a side wall of the concave portion 13 on the side opposite to the opening portion 12. In other words, it is an outer peripheral wall.

The head body 10 includes the base 50 of the hosel portion 5. The base 50 is a portion between the hosel portion 5 and the crown portion 2 or the side portion 4. The base 50 includes a protruding portion 51 that protrudes toward the side of the face portion 1 than the front surface 11. This protruding portion includes an end surface 51*a*. The end surface 51*a* is formed so as to intersect the front surface 11, and an angle θ(refer to FIG. 3A) between the peripheral portion 14 and the end surface 51*a* is, for example, 90° (inclusive) to 110° (inclusive).

The face member 20 includes a front surface 21, a back surface 22 and a peripheral surface 23. The front surface 21 forms the striking surface. The back surface 22 includes a second concave portion 24, a center portion 25, and a peripheral portion 26. The center portion 25 is a portion including a face center FC and is formed to be thicker than the peripheral portion 26. The face center FC can be set by the "Impact Location Template" of a pendulum test prescribed by the R&G and USGA. More particularly, a location which divides the contour of the face portion 1 into halves in the crown-sole direction and in the toe-heal direction can be set as the face center FC.

The concave portion 24 is a portion recessed toward the side of the front surface 21 than the peripheral portion 26 and is an annular groove formed around the center portion 25. The concave portion 24 includes a bottom wall 24*a* and inner walls 24*b* and 24*c* which face each other. The inner wall 24*b* is a side wall of the concave portion 24 on the side of the center portion 25. In other words, it is an inner peripheral wall. The inner wall 24*c* is a side wall of the concave portion 24 on the peripheral side of the face member 20 (the side of the peripheral surface 23 or the side of the peripheral portion 26). In other words, it is an outer peripheral wall.

The connecting portion 30 is arranged in the concave portion 24. The concave portion 24 has an annular form in the same manner as the concave portion 13 and is formed to face the concave portion 13. The connecting portion 30 is arranged to be sandwiched between the concave portions 13 and 24.

The connecting portion 30 is an annular member with an opening portion 31. The opening portion 12, the opening portion 31, and the center portion 25 are arranged to overlap each other in the thickness direction of the connecting portion 30 or the face member 20. In this embodiment, the opening portion 12 is smaller than the opening portion 31, and they are arranged to partially overlap each other. However, the opening portion 12 and the opening portion 31 may be the same size and be arranged to entirely overlap each other. Alternatively, the connecting portion 30 may include a portion inside the concave portion 13 so that the opening portion 31 becomes smaller than the opening portion 12, thereby resulting in an arrangement in which the opening portion 31 and the opening portion 12 partially overlap each other.

The connecting portion 30 is a rectangular sectional plate member. A thickness t (refer to FIG. 4) of the connecting portion 30 is, for example, 1 mm (inclusive) to 10 mm (inclusive). A width W (refer to FIG. 4) of the connecting portion 30 is, for example, 1 mm (inclusive) to 10 mm (inclusive). The widths of the concave portions 13 and 24 may be the same as the width W of the connecting portion 30.

Figure 6A:
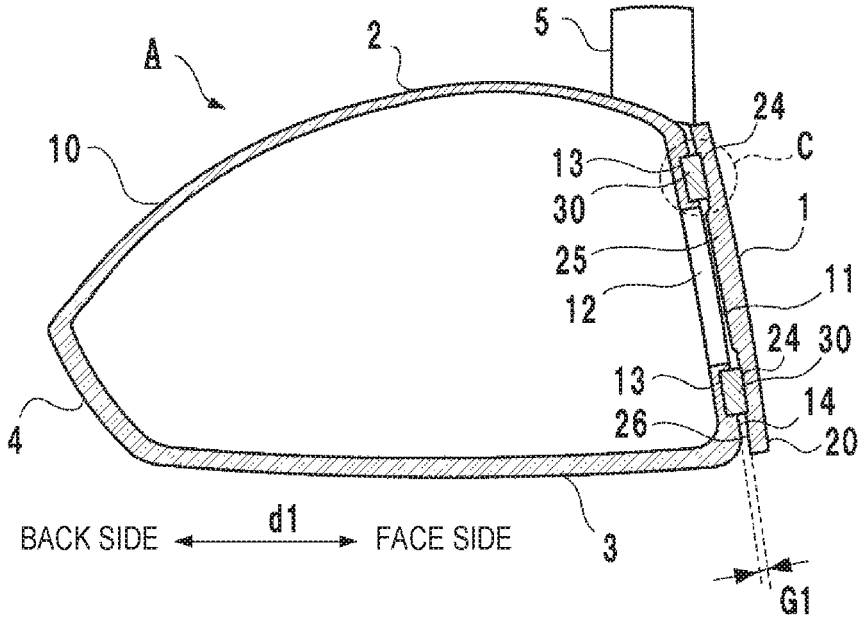
FIG. 6A is a sectional view taken along a line I-I in FIG. 2A.
Figure 6B:
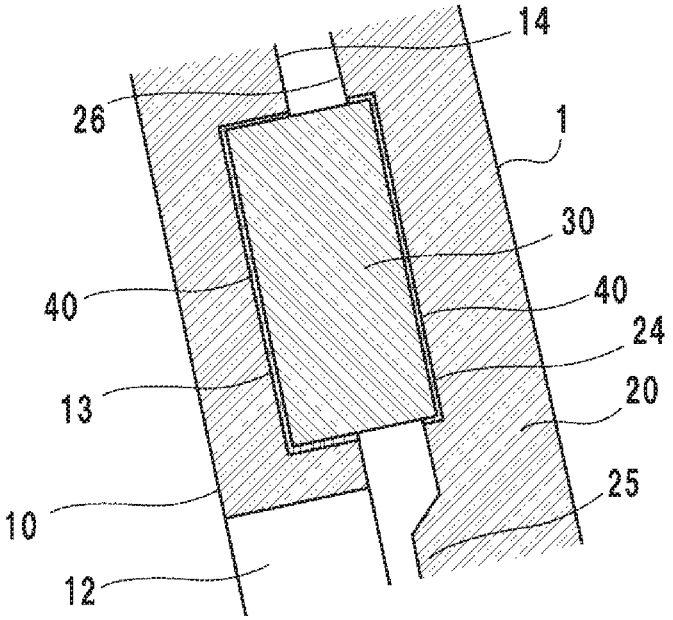
FIG. 6B is an enlarged view of a portion C in FIG. 6A.

A portion at the back side of the connecting portion 30 is fitted into the concave portion 13, and a portion, at the side of the face portion 1, of the connecting portion 30 is fitted into the concave portion 24, respectively. FIGS. 6A and 6B exemplify a case in which the head body 10 and the face member 20 are connected by the connecting portion 30. FIG. 6A is a sectional view taken along a line I-I in FIG. 2A, and FIG. 6B is an enlarged view of a portion C in FIG. 6A.

Various methods are adoptable as the method of joining the connecting portion 30, the head body 10, and the face member 20. In the examples of FIGS. 6A and 6B, the components are joined by an adhesion layer 40. The adhesion layer 40 can be formed by an adhesive or a double sided tape. In the example of FIG. 6B, the adhesion layer 40 is provided throughout the bottom wall and the side walls. However, the adhesion layer may be provided partially on, for example, only the bottom wall.

The connecting portion 30 has a thickness that forms a gap G1 between the front surface 11 of the head body 10 and the back surface 22 of the face member 20 (particularly, between the peripheral portions 14 and 26). In other words, the connecting portion 30 is interposed so that the face member 20 is floatingly supported above the front surface 11. The gap G1 is, for example, 0.5 mm (inclusive) to 5 mm (inclusive).

In the golf club head A having the above arrangement, since the face member 20 is floatingly supported above the front surface 11 by the interposition of the connecting portion 30, the face member 20 can be slightly displaced in an arbitrary direction of its surface direction with respect to the head body 10. Hence, it is possible to reduce the spin amount on a golf ball as the face member 20 is displaced together with the golf ball at impact. Reduction of the back spin amount contributes to the increase in the carry, and reduction of the side spin amount contributes to the prevention of a hook shot or a slice shot. As a result, the ball striking performance is improved. Additionally, by adjusting the material and the hardness of the connecting portion 30, the displacement amount of the face member 20 can be adjusted.

Figure 2B:
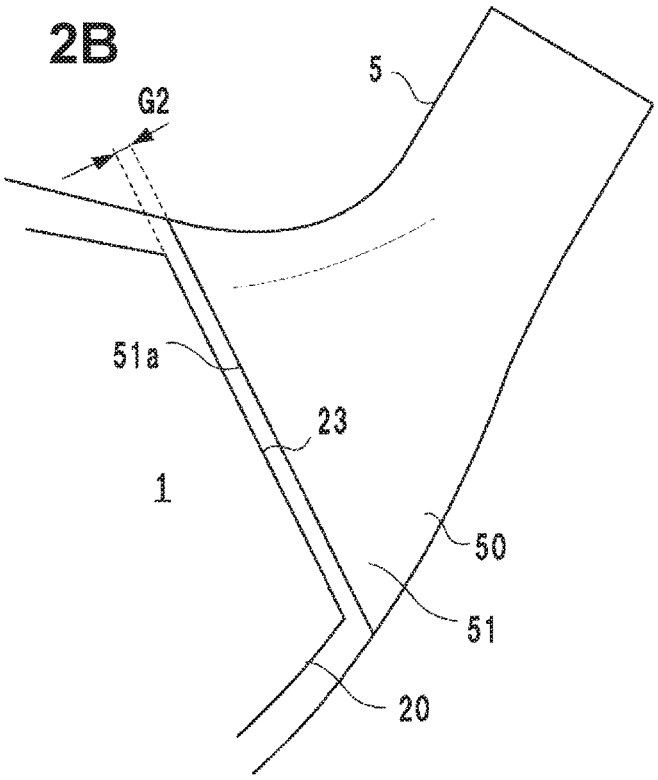
FIG. 2B is an enlarged view of a portion B in FIG. 2A.

A gap G2 is formed between the peripheral surface 23 of the face member 20 and the end surface 51*a* of the base 50 as shown in FIG. 2B which is an enlarged view of a portion B in FIG. 2A. This can either prevent the face member 20 from colliding with the end surface 51*a* upon displacement or prevent the generation of a collision sound. That is, the displacement of the face member 20 and the prevention of collision sound generation are made possible while the same arrangement as that of a conventional golf club head can be adopted for the arrangement of the face portion 1 with respect to the shaft.

Since the opening portion 31 of the connecting portion 30 and the opening portion 12 of the head body 10 are positioned so as to overlap each other on the back of the center portion 25 of the face member 20, the center portion 25 can be displaced to the back side at impact. Hence, the repulsion performance of the face member 20 at impact improves, thereby contributing to the increase in the carry of the golf ball. Therefore, the ball striking performance can also be improved in this point.

The connecting portion 30 is supported by being inserted into the concave portions 13 and 24. Hence, it becomes difficult for the position of the connecting portion 30 to shift with respect to the head body 10 and the face member 20, thereby improving the durability of the connection.

From the above-described reasons, the golf club head A can improve the ball striking performance and increase the durability of the connection between the head body 10 and the face member 20.

<Second Embodiment>

Figures 7A, 7B, 7C:
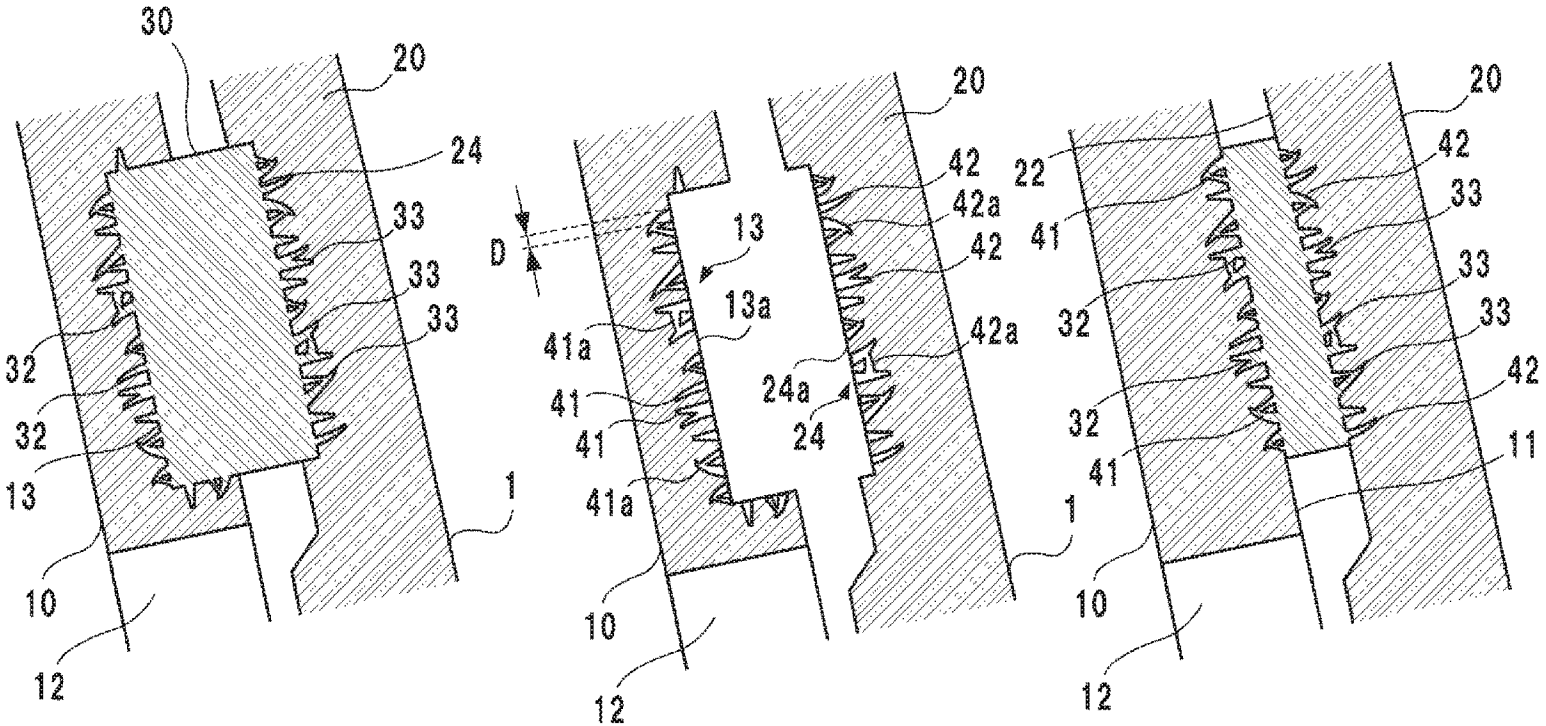
FIGS. 7A to 7C are sectional views showing other joint examples.

In the first embodiment, as shown in FIG. 6B, the connecting portion 30, the head body 10, and the face member 20 are connected by the adhesion layer 40. However, the present invention is not limited to this. FIG. 7A is a sectional view showing another joint example and corresponds to the sectional view of FIG. 6B.

In FIG. 7A, a connecting portion 30 includes impregnated portions 32 and 33 in a head body 10 and a face member 20, respectively. The portions 32 and 33 are formed by filling the pores formed in concave portions 13 and 24 with the material of the connecting portion 30. FIG. 7B is a sectional view of the concave portions 13 and 24 without the connecting portion 30. A plurality of pores 41 are formed in the concave portion 13, and a plurality of pores 42 are formed in the concave portion 24. The pores 41 are open to a bottom wall 13*a* of the concave portion 13, and the pores 42 are open to a bottom wall 24*a* of the concave portion 24. The diameter of the opening (maximum opening width in the bottom wall) of each pore 41 or 42 is, for example, less than 1 mm. The pores 41 and 42 can be formed by laser machining or etching by a chemical agent. As shown in FIG. 7B, the pores 41 can have internally connected pores 41*a* which are pores connected inside the head body 10. Each internally connected pore 41*a* has at least two or more openings as a whole, and the pores communicate with each other inside the head body 10. The pores 42 can have internally connected pores 42*a* in the same manner.

The impregnation of the pores 41 and 42 with the connecting portion 30 can be implemented by insert molding. For example, the head body 10 and the face member 20 can be arranged in a metal die in the positional relationship shown in FIG. 7B, and the thermoplastic resin forming the connecting portion 30 can be injected and molded between the concave portions 13 and 24.

According to the above-described method of joining, since the connecting portion 30 includes impregnated portions 32 and 33 in the head body 10 and the face member 20, the durability of the connection between the head body 10 and the face member 20 can be increased. In particular, since the internally connected pores 41*a* and 42*a* allow the impregnated portions 32 to be connected inside the head body 10, the joining of the head body 10 and the connecting portion 30 becomes stronger. The same also applies to the face member 20 and the connecting portion 30.

FIG. 7A showed an example in which the concave portions 13 and 24 are formed. However, it is possible to adopt an arrangement example in which the concave portions 13 and 24 are not formed. FIG. 7C shows such an example. The example of FIG. 7C shows an example in which the head body 10 and the face member 20 do not include the concave portions 13 and 24, respectively, and the connecting portion 30 includes the impregnated portion 32 and 33 in the head body 10 and face member 20. However, note that the durability of the connection can be further increased when used together with the concave portion 13 or 24.

Additionally, although the examples of FIGS. 7A and 7B each show an arrangement in which pores are formed in both the head body 10 and the face member 20 and the connecting portion 30 includes the impregnated portions, only the head body 10 or the face member 20 may have pores and the connecting portion 30 may includes the impregnated portion for the head body 10 or the face member 20.

Furthermore, various combinations can be adopted as the combination of the concave portions. For example, (1) head body: with pores, without a concave portion/face member: without pores, with a concave portion,
(2) head body: without pores, with a concave portion/face member: with pores, without a concave portion,
(3) head body: with pores, with a concave portion/face member: with pores, without a concave portion,
(4) head body: with pores, with a concave portion/face member: without pores, with a concave portion,
(5) head body: with pores, without a concave portion/face member: with pores, with a concave portion, and
(6) head body: without pores, with a concave portion/face member: with pores, with a concave portion, are adoptable as the combination.

<Third Embodiment>

Figure 8A:
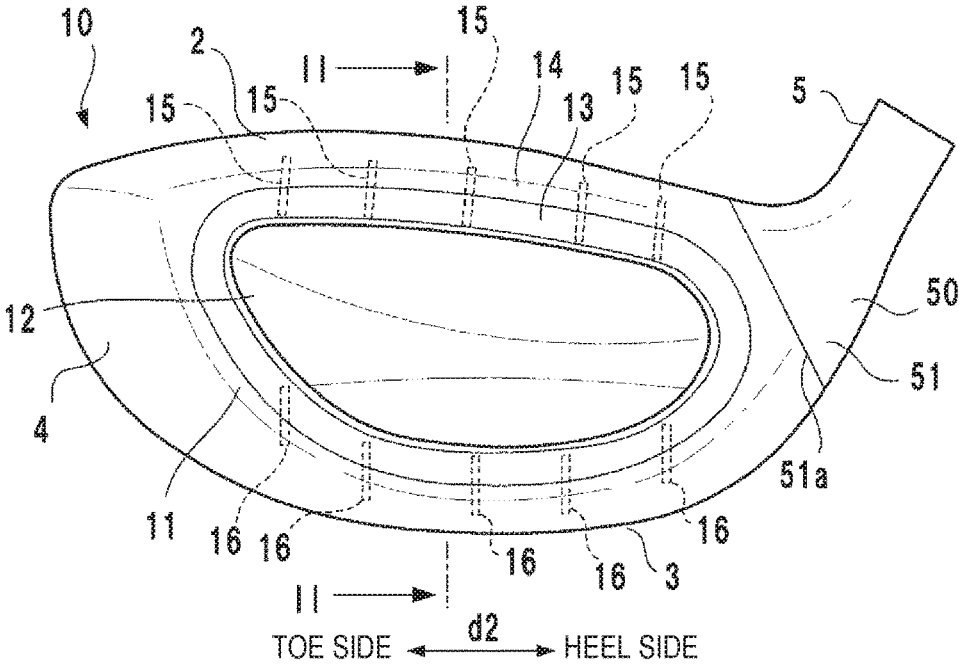
FIG. 8A is a front view of another example of a head body.
Figure 8B:
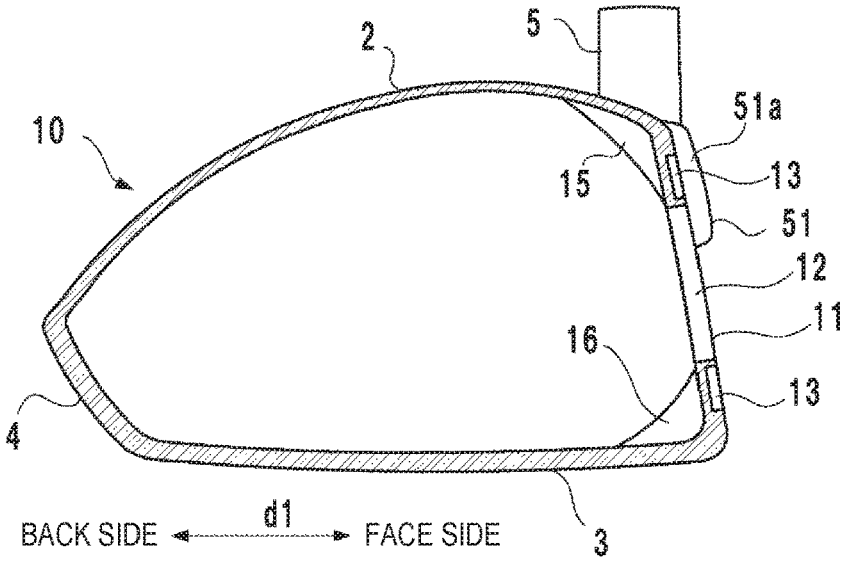
FIG. 8B is a sectional view taken along a line II-II in FIG. 8A.

Ribs for reinforcement can be formed around an opening portion 12 of a head body 10. FIG. 8A is a front view of the head body 10 showing such an example, and FIG. 8B is a sectional view taken along a line II-II in FIG. 8A. In the example of FIG. 8A, a plurality of ribs 15 and 16 are formed around the opening portion 12. The plurality of ribs 15 are arranged in a d2 direction along the upper edge of the opening portion 12, and each rib 15 is formed from the upper edge of the opening portion 12 to a crown portion 2. The plurality of ribs 16 are arranged in the d2 direction along the lower edge of the opening portion 12, and each rib is formed from the lower edge of the opening portion 12 to a sole portion 3. The rigidity around the opening portion 12 can be increased by forming the ribs 15 and 16.

<Fourth Embodiment>

The rigidity or the hardness of a connecting portion 30 can be changed depending on the region. For example, a region on the side of a crown portion 2 can have a low rigidity or hardness, and a region on the side of a sole portion 3 can have a high rigidity or hardness. This can increase the launch angle of the struck ball. As the method of changing the rigidity or the hardness of the connecting portion 30 depending on the region, a method of forming the connecting portion 30 by using a plurality of materials or a method of forming the connecting portion 30 by changing the dimensions (for example, the thickness) of a single material can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-119122, filed Jun. 15, 2016, which is hereby incorporated by reference herein in its entirety.

What is claimed is:

1. A hollow golf club head that includes a face portion, comprising:

a hollow head body;

a face member that forms the face portion; and a connecting portion that is provided between the head body and the face member and connects the head body and the face member, wherein the head body includes a front surface to which the face member is connected through the connecting portion, the front surface of the head body includes:

an opening portion; and a first concave portion formed around the opening portion and on which the connecting portion is arranged, the back surface of the face member includes a second concave portion on which the connecting portion is arranged, and the front surface of the head body includes a peripheral portion around the first concave portion, and the connecting portion has a thickness to form a gap between the peripheral portion and the back surface of the face member.

2. The golf club head according to claim 1, wherein the material of the connecting portion is a nonmetallic material.

3. The golf club head according to claim 1, wherein the connecting portion includes an opening portion that at least partially overlaps the opening portion of the head body.

4. The golf club head according to claim 3, wherein the opening portion of the head body and the opening portion of the connecting portion overlap the center of the face portion.

5. The golf club head according to claim 1, wherein the head body includes:

a hosel portion to which a shaft is attached; and a base of the hosel portion, the base includes a protruding portion that protrudes to the side of the face portion than the front surface, the protruding portion includes an end surface that intersects with the front surface, and a gap is formed between the end surface and the face member.

6. A hollow golf club head that includes a face portion, comprising:

a hollow head body;

a face member that forms the face portion; and a connecting portion that is provided between the head body and the face member and connects the head body and the face member, wherein a plurality of pores are formed in a front surface of the head body and/or a back surface of the face member, the plurality of pores are impregnated with the connecting portion, and a diameter of an opening of each of the plurality of pores is less than 1 mm.

7. The golf club head according to claim 6, wherein the front surface of the head body includes an opening portion.

8. The golf club head according to claim 6, wherein a concave portion on which the connecting portion is arranged is formed in the front surface of the head body and/or the back surface of the face member.

9. The golf club head according to claim 6, wherein the head body includes:

a hosel portion to which a shaft is attached; and a base of the hosel portion, the base includes a protruding portion that protrudes to the side of the face portion than the front surface, the protruding portion includes an end surface that intersects with the front surface, and a gap is formed between the end surface and the face member.

* * * * *